US006758372B2

(12) United States Patent
Studer et al.

(10) Patent No.: US 6,758,372 B2
(45) Date of Patent: Jul. 6, 2004

(54) DEVICE FOR DISPENSING SOAP-SOLUTION IN A DISPENSER

(75) Inventors: Hans-Jörg Studer, Hittnau (CH); Markus Ehrensperger, Hettlingeg (CH)

(73) Assignee: HTS International Trading AG, Baar (CH)

( * ) Notice: Subject to any disclaimer, the term of this patent is extended or adjusted under 35 U.S.C. 154(b) by 194 days.

(21) Appl. No.: 10/169,531

(22) PCT Filed: Jan. 16, 2001

(86) PCT No.: PCT/CH01/00029

§ 371 (c)(1),
(2), (4) Date: Jun. 28, 2002

(87) PCT Pub. No.: WO01/52710

PCT Pub. Date: Jul. 26, 2001

(65) Prior Publication Data

US 2003/0071058 A1 Apr. 17, 2003

(30) Foreign Application Priority Data

Jan. 19, 2000 (EP) ..... 00810043

(51) Int. Cl.[7] ..... B67D 5/00

(52) U.S. Cl. ..... 222/88; 222/81; 222/83.5; 222/181.1; 222/181.2; 222/325; 141/330

(58) Field of Search ..... 222/80–83, 83.5, 222/87–90, 94, 105, 325, 181.1, 181.2, 506, 509, 448; 141/330

(56) References Cited

U.S. PATENT DOCUMENTS 3,250,438 A * 5/1966 Packwood, Jr. ..... 222/181.2
3,912,125 A * 10/1975 Acklin ..... 222/165
4,214,676 A * 7/1980 Cassia ..... 222/83.5
4,391,309 A * 7/1983 Steiner ..... 141/18
4,429,812 A * 2/1984 Steiner et al. ..... 222/181.2
4,901,890 A * 2/1990 Mivelaz ..... 222/395
5,100,030 A * 3/1992 Roggenburg et al. .... 222/181.2
5,102,010 A * 4/1992 Osgar et al. ..... 222/1
5,732,853 A * 3/1998 Ganzeboom et al. ..... 222/82
5,779,104 A * 7/1998 Reidel ..... 222/190

FOREIGN PATENT DOCUMENTS

DE EP-0116812 A1 * 8/1984 ..... A47K/5/12

* cited by examiner

*Primary Examiner*—Gene Mancene
*Assistant Examiner*—Frederick C. Nicolas
(74) *Attorney, Agent, or Firm*—Schweitzer Cornman Gross & Bondell LLP

(57) ABSTRACT

With soap and cleansing foam dispensers, there is a risk that they may be equipped with supply containers of unsuitable liquid or that their intermediate containers may become contaminated. According to the invention, an adapter (8) that is mounted on an intermediate container (6) has a coded cylindrical jacket (10), into which coded parts (4,5) that are positioned on the neck of a suitable supply container (2) can be fitted. To prevent the contamination of the intermediate container (6), the latter has a spring-loaded internal sealing plug (50) which ensures the hygienic sealing of the container even prior to use and when the supply container is changed. To prevent interruptions in the operation, a reliable fill-level indicator (22) is provided. The device thus ensures improved, hygienic dispensing of soap-solution in dispensers (1).

10 Claims, 4 Drawing Sheets

DEVICE FOR DISPENSING SOAP-SOLUTION IN A DISPENSER

Figure 1:
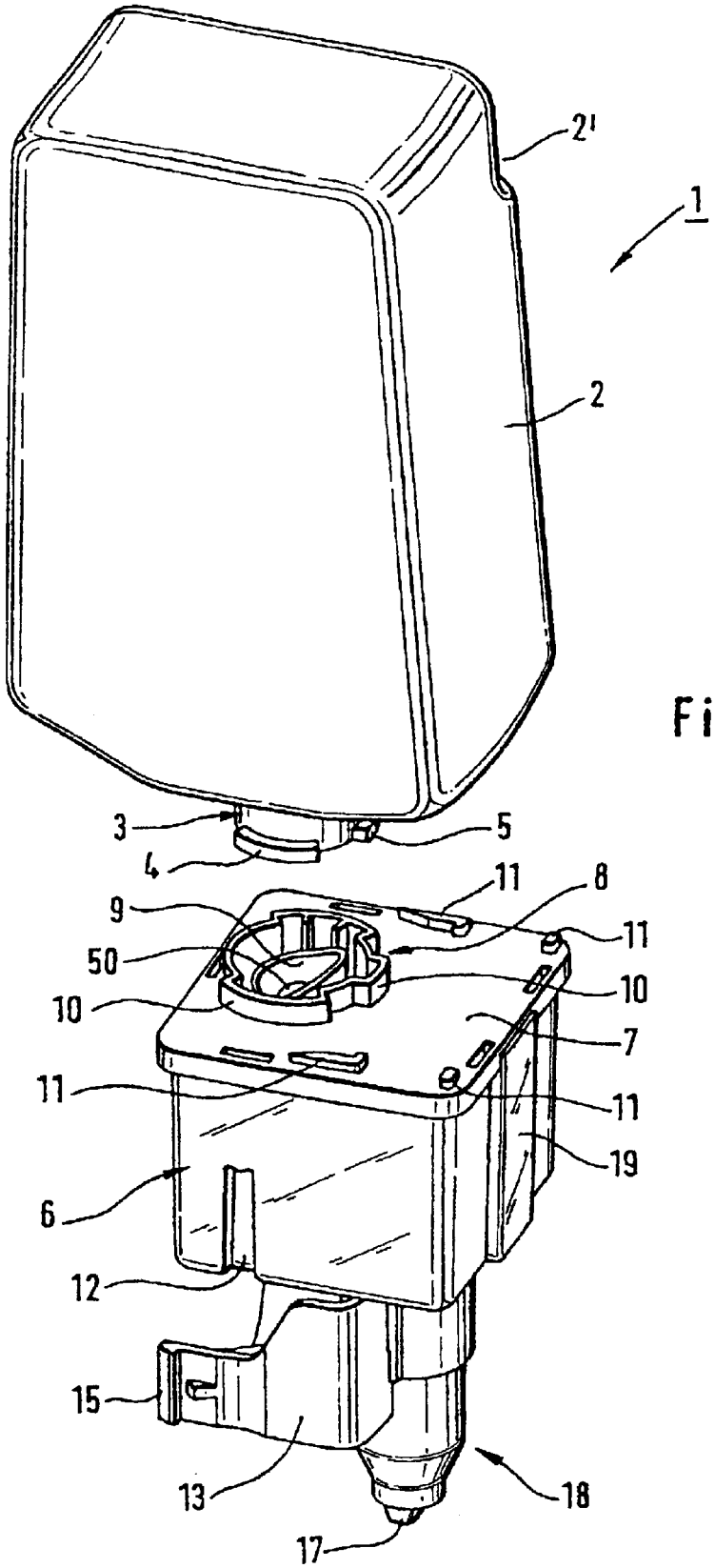

The present invention relates to a device according to the preamble of claim 1.

Known soap and foam dispensers (inter alia EP-B1-0 019 582) have supply bottles for a soap solution (emulsion, dispersion, etc.) which are placed upside down in an intermediate container which maintains a relatively constant level of liquid in the manner of a birds' drinking vessel in order to feed a downstream metering device.

It has been found that during the operation of such a dispenser the intermediate container is contaminated by impurities in the atmosphere and that after more or less long use such a dispenser has a high germ count and therefore, instead of serving to clean hands, it also contaminates them.

The above-mentioned problems represent a great risk owing to the increasing number of infectious diseases, especially in factories and organizations that manufacture and/or distribute foodstuffs, or in the health sector (hospitals, etc.).

It has also been found to be disadvantageous that known dispensers—in the often very limited lighting conditions of wash-rooms—have an inadequate filling-level indicator, so that such dispensers are often without a continuous flow of soap solution which of course also greatly impairs hygiene conditions.

Furthermore, an empty intermediate container is a receiving reservoir for countless germs which remain in the system or multiply therein even when a fresh supply container is subsequently inserted.

In addition, the market offers various qualities of soap which, depending on teir purpose, are suitable only for specific dispensers and places of use. For example, soap solutions that are used in sectors requiring a high level of hygiene contain anti-bacterial additives and soap solutions that are used in other sectors contain fat-replenishing active substances and/or perfumes. Furthermore, foam dispensers require soap solutions having different physical properties, especially a higher viscosity, from those necessary, for example, in soap dispensers.

In the past, therefore, dispensers were often equipped with unsuitable soap solutions or supply bottles that were intended for other dispensers and/or places of use.

The object of the invention is to remove those disadvantages and to avoid the risks indicated, that is to say, the hygiene conditions in the dispenser are to be improved and the supply containers are not to be confused.

At the same time, indication of the necessity to replace the supply container is to be improved so that a dispenser which is running dry is recognized in good time. The reserve is also to be sufficiently large to prevent any interruption in operation.

A further object is to provide a device which prevents appliances from becoming contaminated before their first use, for example during dispatch or storage. The problem is solved by the features of patent claim 1; claim 1 characterizes the operating state.

The device according to the invention prevents the use of unsuitable supply containers, that is to say, such containers cannot even be opened by the dispenser because the piercing sleeve does not project into the region of the diaphragm of a container that does not fit.

The resiliently supported closing plug prevents the penetration of impurities into the intermediate container, on the one hand, before the insertion of a supply bottle and, on the other hand, also when that bottle is exchanged or removed, because the closing plug recloses the inlet to the intermediate container without delay.

In addition, a liquid level having a relatively large surface is established in the intermediate container, as a result of which a very narrow labyrinthine edge opening to the surrounding atmosphere is quite sufficient to obtain the effect of a "birds" drinking vessel".

Developments of the subject-matter of the invention are described in the following dependent claims.

A form of keying according to claim 2 is economical because it can also be produced for a standard bottle in numerous non-confusable variants.

The construction of the keying members in the form of ring segments is favorable from the point of view of production technology.

The form according to claim 4 is space-saving and requires only a small amount of material, that is to say, the closing cover carrying it can be very thin-walled. Furthermore, a raised edge facilitates the insertion of a keyed neck of a bottle.

The use of webs and recesses increases the possible combinations considerably.

Especially in the case of more highly viscous soap solutions, the form according to claim 6 ensures a defined position and a corresponding opening angle of the closing plug.

A labyrinthine air inlet prevents the penetration of germs and lets in only as much air as the amount of liquid removed.

The form of the filling-level indicator according to claim 8 gives very good optical conditions and permits the favorable arrangement thereof at the dispenser housing.

A float can be guided by an upright guide strip in an especially simple and operationally reliable manner.

Lateral guide strips according to claim 10 prevent the float from tilting.

Figure 2:
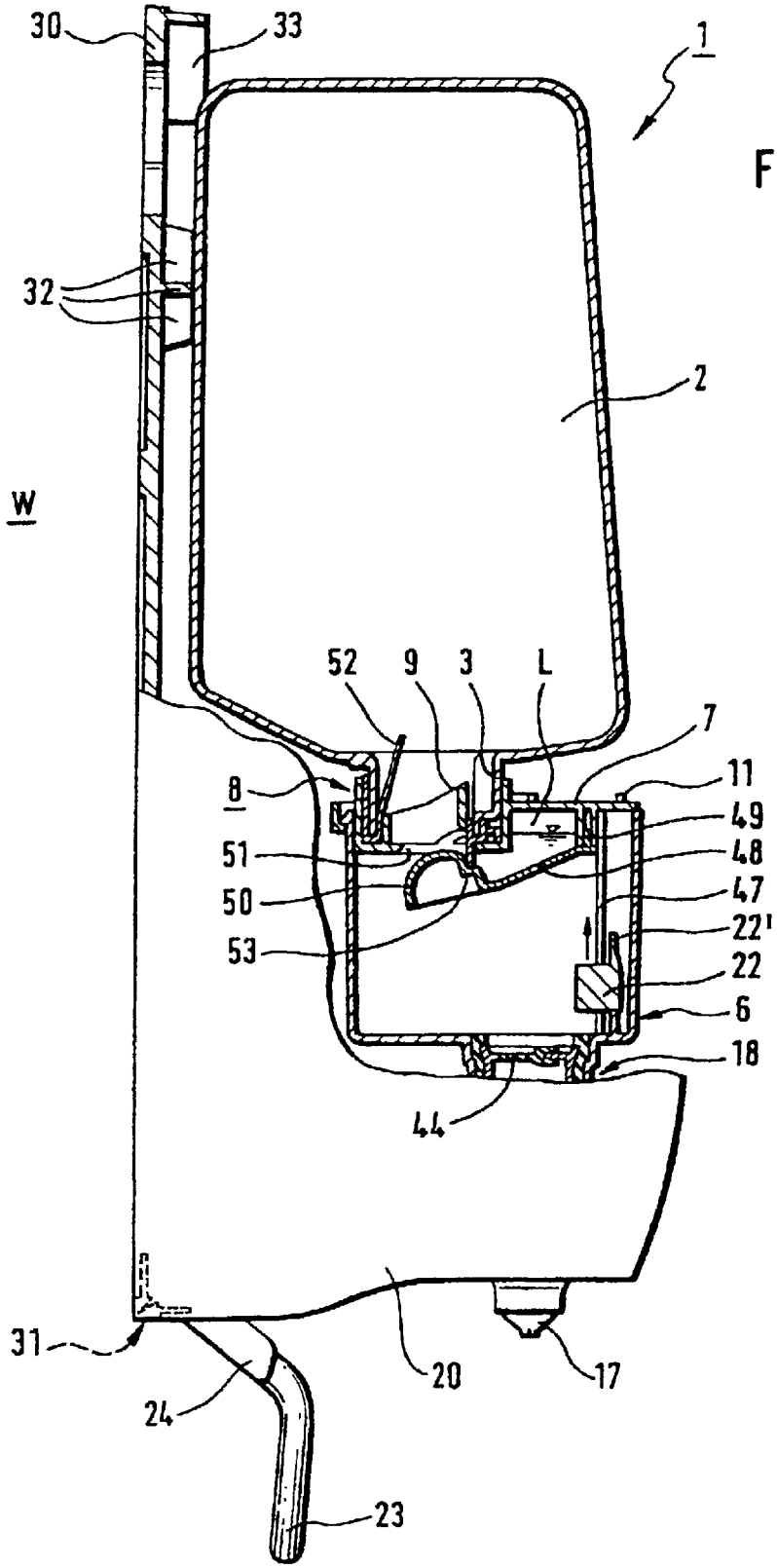
Figure 3A:
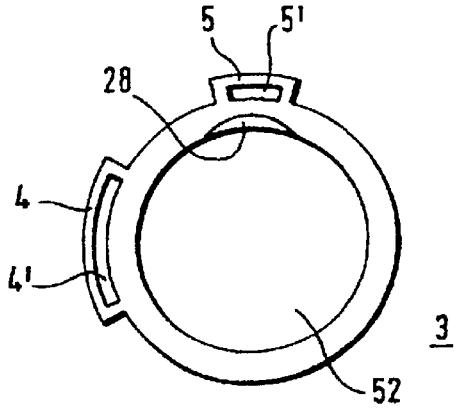
Figure 3B:
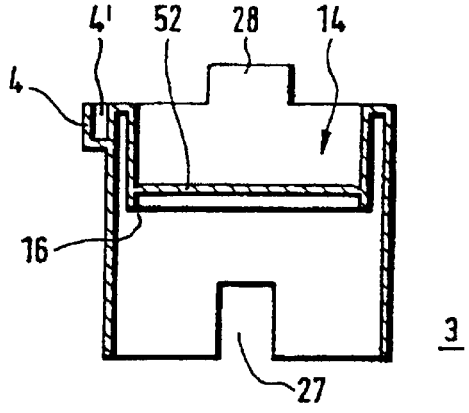
Figure 4A:
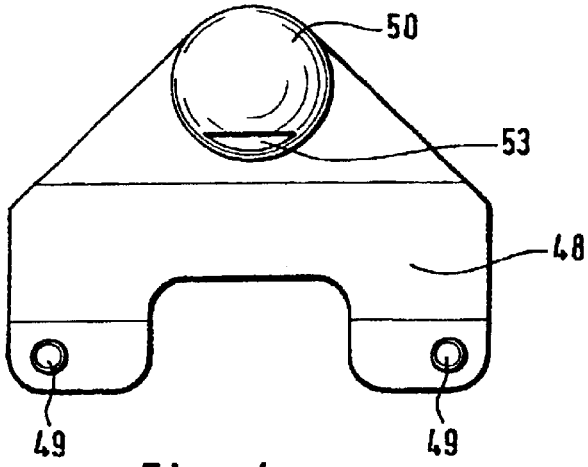
Figure 4B:
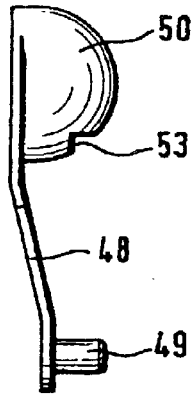
Figure 5:
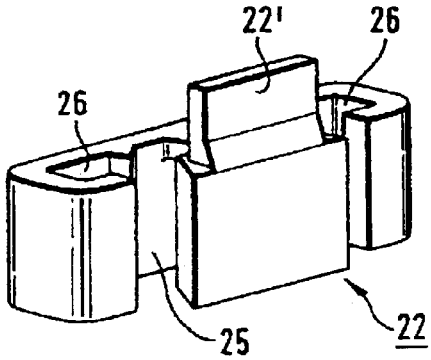
Figure 6:
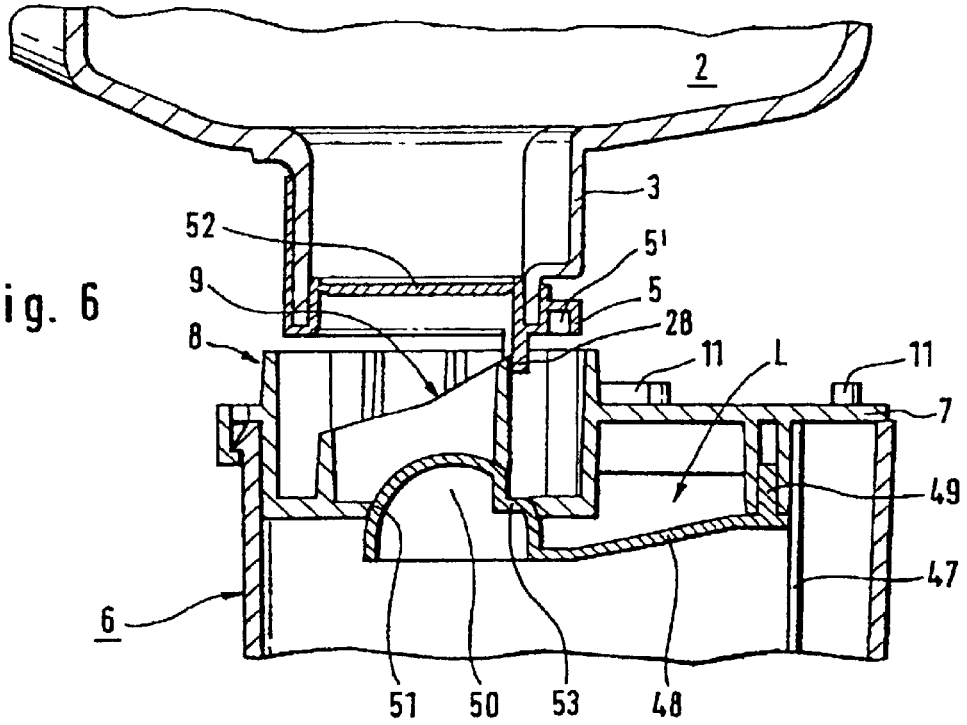
Figure 7:
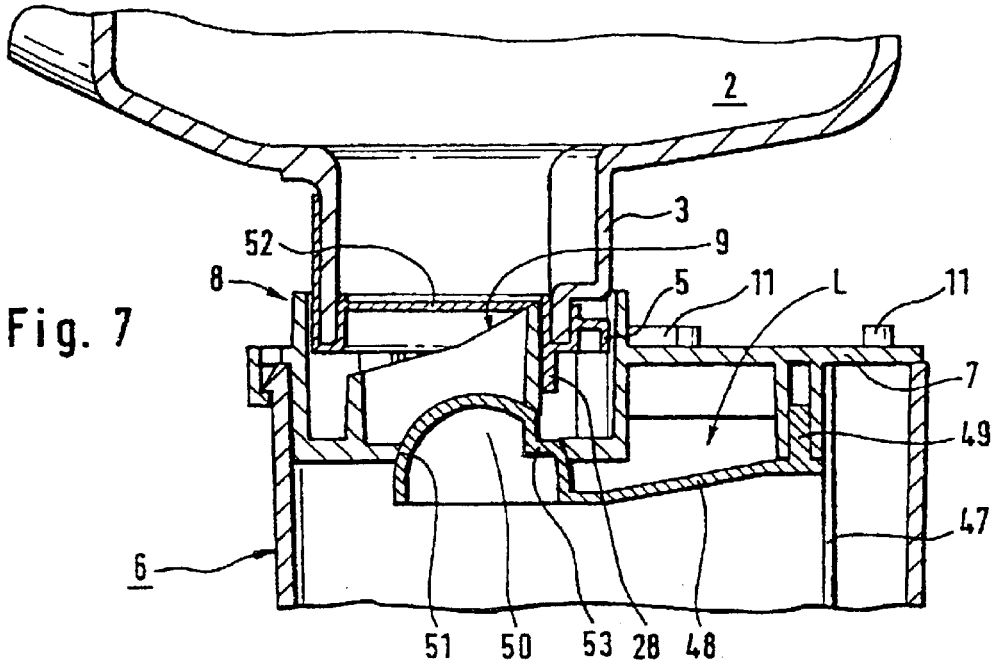

FIG. 1 shows a dispenser represented in a simplified manner having an intermediate container for soap solution with an adapter and associated supply bottle, FIG. 2 shows the complete dispenser according to FIG. 1 in a partly sectional view and in its functioning state, FIG. 3*a* shows a push-on member for the neck of the supply container in FIG. 1 in plan view, FIG. 3*b* is a view of the push-on member of FIG. 3*a* in vertical section, FIG. 4*a* shows the form of a closing member in the dispenser of FIG. 1 and FIG. 2 in plan view, FIG. 4*b* shows the closing member of FIG. 4*a* viewed from the side, FIG. 5 shows the form of a float of a filling-level indicator in the dispenser according to FIGS. 1 and 2, FIG. 6 is an enlarged sectional view of the intermediate container of FIG. 1, at the beginning of the fitting of a supply bottle and FIG. 7 is a view analogous to FIG. 6 during the fitting of the supply bottle.

In FIG. 1, 1 denotes a soap dispenser which has a supply container 2 known per se for a soap solution. A recess 2' which provides space for a system for locking the dispenser is provided in the upper portion of the rear lateral face of the container 2; keying members 4 and 5 are provided on the bottle neck 3 of the supply container 2.

Underneath, and drawn at a distance from the supply bottle 2 for reasons connected with draftsmanship, is an intermediate soap solution container 6 which is used, likewise in a manner known per se, as a reservoir for the soap solution and permits a smooth exchange of the container 2 without interruptions in operation. The intermediate container 6 has a modular structure and has a closing cover 7 with an adapter 8 which is closed centrally by a resiliently arranged closing plug 50, as long as a supply container 2 has not been fitted.

In order to prevent the use of unsuitable supply containers 2, for example those which contain a special soap solution suitable only for foam dispensers, a keying edge 10 is provided here. The edge 10 acts as a receiving negative with respect to the keying members 4, 5 and is adapted to the members 4 and 5, while maintaining a suitable play, so that the correct supply container 2 can be readily inserted into the adapter 8 and locked. An unsuitable container 2 cannot be used.

The intermediate container 6 also has, on its closing cover 1, clamping and locking members 11 which are used for the insertion and holding thereof in the dispenser housing which is shown here only in simplified form. In order to prevent the intermediate container 6 from rotating, the container also has a lateral guide 12 constructed in the form of a recess. Arranged below the container 6 is a pump support 13 with a spring member 15 which is arranged in one piece thereon and which has a sectional end member which is likewise used for holding in the dispenser housing. The pump support 13 contains a hose pump 18 having an outlet 17 in the form of a rubber lip for the delivery of liquid soap in portions. A projecting upright member 19 in which an indicator flag for the filling level of the soap solution is held can be seen at the front of the intermediate container 6.

The sectional view of FIG. 2 shows the subject-matter according to FIG. 1 installed in a soap dispenser 1 for mounting on a wall W. The soap dispenser 1 is secured in a well-known manner with its rear wall 30 against the wall W. At the lower end of the rear wall 30 is an articulation 31 (film hinge) for a hood 20, which is partially illustrated here. A locking cam 33 which is used to close the hood 20 can be seen at the upper end of the rear wall 30. Below the cam are support ribs 32 which are used for the vertical positioning of the supply container 2. A cut-open diaphragm 52 projects upwards in the bottle neck 3 of the container 2 and is held in that position, which allows soap solution to flow through, by the piercing sleeve 9.

It can be seen that a member projecting from the bottle neck 3 holds the hemi-spherical closing plug 50 in the open position shown; soap can therefore flow between the closing plug 50 and its valve seat 51, as a result of which the liquid level illustrated to the right of the bottle, neck 3 is maintained and an air space is formed above it which is replenished through an extremely small edge gap between the closing cover 7 and the actual container 6.

In addition, a guide strip 47 on which a float 22 having a short top-side flag 22' slides vertically upwards can be seen in the intermediate container 6. Thus, the illustrated position corresponds to a state with an almost empty intermediate container and contradicts the level of the soap solution.

According to FIG. 2 the hose pump 18 which is closed by a flap valve 44, which is a non-return valve, is inserted in the lower base of the intermediate container 6.

An operating lever 24, having an operating ring 23, and the soap outlet 17 project from the hood 20.

FIG. 3*a* and FIG. 3*b* show that the bottle neck 3 is a member fitted to the outlet of the container 2 and is connected to that outlet (not shown) in a positive-locking and liquid-tight manner.

The plan view according to FIG. 3*a* shows the two keying members 4 and 5 having recessed grooves 4' and 5', and a projection 28. The diaphragm 52 described in FIG. 2 is located in the center, but in the closed state.

FIG. 3*b* is a horizontally arranged vertical section through the bottle neck 3 of FIG. 3*a*. It shows the thin-walled dimensioning and a depression 14 which is closed by the diaphragm 52. The height of the projection 28, a centering edge 16 for positioning the container outlet, and a lower recess 27 are also shown.

The recess 27 corresponds to a raised portion (not shown) at the outlet of the container 2, so that a standard supply container, depending on what it has been filled with, can be equipped with corresponding attachments according to FIG. 3*a* and FIG. 3*b* used for identification and keying.

The detailed form of the closing plug 50 with its spring leaf 48 and the mounting pins 49 can be seen in FIG. 4*a*. In conjunction with FIG. 4*b* that Figure shows in the closing plug 50 a notch 53 into which extends the projection 28 which is at the same time used for the parallel guiding of the container 2 during insertion into the adapter 8, see FIG. 2.

The form of the float 22 can be seen in FIG. 5 which shows a sectional guide member 26 provided with grooves; the actual float body 25 is constructed as a hollow body in known manner.

The operation of fitting a soap-filled supply bottle 2 to the adapter 8 of the closing cover 7 is shown in FIG. 6 in an enlarged view.

FIG. 7 shows the piercing of the diaphragm 52 in the bottle neck 3, in which position the closing plug 50 still abuts the valve seat 51.

The lower position of the bottle neck 3 corresponds to the operating position and has been described in detail in connection with FIG. 2.

The subject matter of the invention permits a hygienically excellent delivery of soap solutions for metering in a soap or foam dispenser without contaminated atmosphere and/or other influences affecting the quality of the solution and the dispenser.

The device can be manufactured by conventional plastics technology and can be readily integrated in existing dispenser structures.

The exchange of a supply container does not require instructions; either a container fits into a dispenser or the dispenser requires another type of container.

It will be appreciated that the subject-matter of the invention is not restricted to what has been presented; for example, functional members which have been drawn separately can be constructed in one piece, which is advantageous, in particular, in the case of components manufactured in large piece numbers. The keying can be integrated into and/or injection-molded onto, inter alia, the bottle neck of the supply container.

What is claimed is:

1. A device for delivery of soap solution from an inverted supply container into an intermediate container of a dispenser, a bottle-neck outlet having a pierce-able diaphragm being provided on the container and an adapter having a piercing sleeve being provided on the intermediate container, characterized in that at least one keying member projects from the bottle neck, the adapter having an analogously keyed cylindrical surface to accept the keying member, and in that there is provided, in a region of the adapter below the piercing sleeve, a valve seat having a resiliently supported closing plug which is pushed through the bottle neck into a through-flow position, a tip of the piercing sleeve being supported below an upper edge of the adapter.

2. The device according to claim 1, characterized in that the bottle neck has a push-on member to which at least two keying members are fitted.

3. The device according to claim 2, characterized in that the keying members are ring segments.

4. The device according to claim 1, characterized in that the keyed cylindrical surface has a raised edge.

5. The device according to claim 4, characterized in that the keyed cylindrical surface has webs and recesses.

6. The device according to claim 1, characterized in that there is a projection provided on the bottle neck and parallel therewith which extends peripherally relative to the piercing sleeve through a closing cover of the intermediate container, and a notch is provided in the closing plug against which the projection presses to hold the closing plug in a through-flow position.

7. The device according to claim 6, characterized in that the closing cover has edge gaps opposite an upper portion of the intermediate container, which gaps are in the form of labyrinthine air inlets to an air space in the intermediate container.

8. The device according to claim 1, characterized in that a filling-level indicator having a float is arranged in a projection in the intermediate container.

9. The device according to claim 8, characterized in that an upright guide strip on which the float is guided is provided behind a projection in the intermediate container.

10. The device according to claim 8, characterized in that the float has lateral grooves through which guide strips extend.

* * * * *